US005406463A

United States Patent [19]

Schexnayder, Sr.

[11] Patent Number: 5,406,463

[45] Date of Patent: Apr. 11, 1995

[54] CHEMI-LUMINESCENT DISPLAY FOR, FOR EXAMPLE, EMERGENCY SIGN USE

[76] Inventor: Louie M. Schexnayder, Sr., 111 Schexnayder La., Hahnville, La. 70057

[21] Appl. No.: 249,884

[22] Filed: May 25, 1994

[51] Int. Cl.[6] ..... F21K 2/06; G09F 13/20

[52] U.S. Cl. ..... 362/34; 362/812; 40/542

[58] Field of Search ..... 362/34, 812; 40/541, 40/542

[56] References Cited

U.S. PATENT DOCUMENTS

| | | | |
|---|---|---|---|
| 3,808,414 | 4/1974 | Roberts | 362/34 |
| 4,061,910 | 12/1977 | Rosenfeld | 362/34 |
| 4,405,973 | 9/1983 | Moscarillo | 362/34 |
| 4,677,008 | 6/1987 | Webb | 428/34.4 |
| 4,751,616 | 6/1988 | Smithey | 362/34 |
| 4,814,949 | 3/1989 | Elliott | 362/34 |
| 5,177,812 | 1/1993 | DeMars | 362/105 |
| 5,226,710 | 7/1993 | Giglia et al. | 362/34 |

*Primary Examiner*—Ira S. Lazarus
*Assistant Examiner*—Sara Sachie Raab
*Attorney, Agent, or Firm*—C. Emmett Pugh; Pugh/Associates

[57] ABSTRACT

An octagonally-shaped, orange colored sign display (10) having intelligible, informational indicia (20) thereon, such as "CALL 911," using chemi-luminescence to provide illumination from within the indicia in emergency situations. The indicia consist of a series of separate, hollow, formed containers, which are made of at least translucent, if not transparent, material and contain a special, generally isolated chemical, which is ultimately mixed with another special chemical located in an upper, horizontally disposed, reservoir tube (30/330), with the tube connected to the indicia containers by connector lines (40). A membrane divider (31/331) extends across the bottom portion of the reservoir tube, isolating the upper chemical from the lower chemical, until steps are taken to break or rupture it. The two chemi-luminescent chemicals are mixed by breaking the membrane by bending the tube until the membrane breaks. The chemi-luminescent reaction causes the indicia to brightly stand out against the background of the display due to their internal illumination and thereby be highly visible or noticeable, as well as easily intelligible, to passing motorists or other passers-by. The reservoir and individual indica can be made from transparent plastic tubes, with the latter being made in the form of the desired lettering of the indicia, with a separate, horizontally disposed reservoir being provided for each line of lettering. In an alternative embodiment (FIGS. 4–6) both chemicals are contained in a dual compartmented, replaceable reservoir which snaps onto the tops of the indicia and, thereafter, on activation flow into the indica to internally illuminate them.

20 Claims, 5 Drawing Sheets

Fig. 1
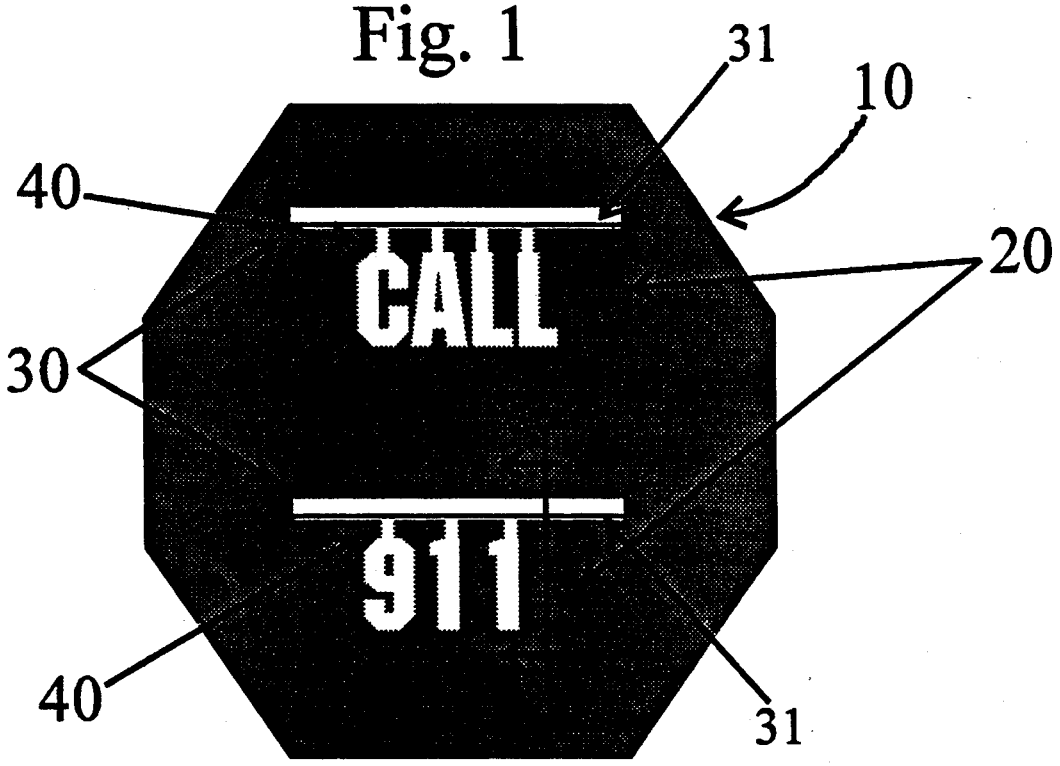
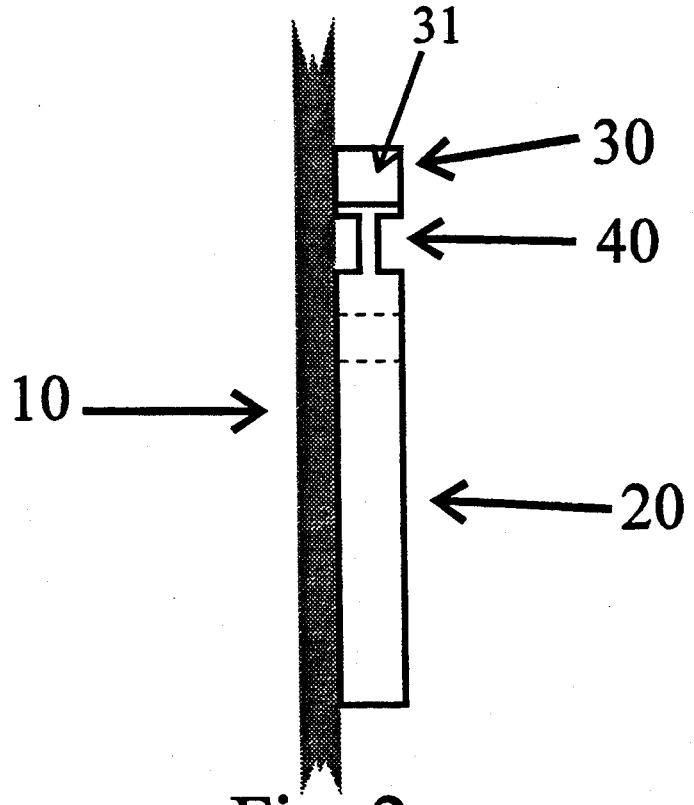
Fig. 2

CHEMI-LUMINESCENT DISPLAY FOR, FOR EXAMPLE, EMERGENCY SIGN USE

TECHNICAL FIELD

The present invention is directed to an illuminated display, for example, an emergency sign which includes the message "CALL 911" (or any other appropriate message or design or other indicia). The present invention relates even more particularly to such a display in which the lettering is made of hollow elements manufactured preferably in the actual form of each of the needed lettering, numerals and/or symbols or designs or other indicia, with at least one of the chemi-luminescent chemical being contained in a connected but isolated and separated tube or other form of reservoir. In one embodiment of the invention one of the chemi-luminescent chemical is contained in the indicia elements themselves, while in the other embodiment both chemicals are contained in a dual compartmented, replaceable, snap-on reservoir. In both embodiments, the mixed chemicals producing the light source for the sign ultimately reside in the hollow indica elements, internally illuminating the lettering or indicia when the chemicals are ultimately located together inside the indicia elements. In the invention the reservoir and the indicia elements are not placed one inside the other but are located side-by-side interconnected by communicating openings or connector lines.

BACKGROUND ART

"Light sticks" are well known in the art and readily available "off-the-shelf." A "light stick" typically comprises a transparent, elongated, cylindrical structure which contains within it two different, separated chemicals, one of which is separately contained in an internal capsule made of glass or other fracturable material. When it is desired to illuminate a "light stick", the cylindrical structure is flexed against its longitudinally center line a significant amount, causing the internal glass capsule to break, allowing the two chemicals to mix. The resulting chemical mixture produces an chemi-luminescent reaction which gives off light for an extended period of time [e.g. eight (8) hours].

One prior manufacture of the "light sticks" is American Cyanamid which has sold the product under the trademark "CYALUME"; and their packaging cites U.S. Pat. Nos. 3,539,794 & 3,597,362.

The American Cyanamid commercial materials show a number of uses of these types of products including a circular type badge containing within it the illuminating chemicals, on the exterior of which badge is imprinted a message, but the lettering itself is not made of the "light stick" type structures. Other uses include providing the "stick" in oval or circular or other configured forms rather than just a cylindrical stick.

The below listed prior patents found as a result of a search were considered at least generally pertinent to the invention:

| Patent No. | Inventor | Issue Date |
|---|---|---|
| 4,061,910 | Rosenfeld | |
| 4,405,973 | Moscarillo | |
| 4,677,008 | Webb | |
| 4,751,616 | Smithey | 06/14/88 |
| 4,814,949 | Elliott | |

The '616 and '949 patents indicate that they also are or were assigned to American Cyanamid.

The '910 patent to Rosenfeld is directed to articles of jewelry (e.g. a closed loop or triangular shaped items, ring, etc.) made of chemi-luminescent material.

The '973 patent to Moscarillo is directed to "emergency light sources" using chemi-luminescent to for, for example, illuminate a compass.

The '616 patent to Smithey (American Cyanamid) provides further information on the chemicals used and the chemical action which takes place in chemi-luminescent devices.

The '949 patent to Elliott (American Cyanamid) suggests the use of chemi-luminescent designs that "can be in any desired shape such as a geometric shape, i.e., square, rectangle, circle, cross, etc., or an arrow, letter, heart, number, etc. Indicia may be printed or otherwise imparted to either surface of the first polymeric sheet." (Col. 3, lines 34–38.) The drawings illustrate a heart shape (FIGS. 1–6) and an arrow shape (FIG. 7). Since the specification indicates that the indicia may be printed, although the specification is somewhat vague and unclear, this patent apparently teaches that indica such as "letters" or "numbers" are imprinted on the outer surface of the sheet 1.

Thus, in most, if not all, of the prior art designs, the container for one chemical encloses and encases the container for the other, typically with the flexing or bending of one rupturing or fracturing the other inside of the first. Additionally, it is believed that none teach or suggest the use of separate indicia container for one of the chemicals, with the other chemical being contained in a separate reservoir completely outside of and laterally spaced from the indicia containers, with the reservoir supplying a multitude of separate indicia containers; nor is there a suggestion of both chemicals being isolatingly contained in a separate reservoir that can be snapped on and off for replacement.

The other reference ('008 to Webb), not specifically discussed above, is cited only for general, background information.

Of course, it is also old, generally speaking, to have emergency signs asking for help on the road, including such signs in which the shape is that of an octagon or "stop" sign shape. However, none have the ease and high visibility of the present invention, and any illuminated ones usually require access to AC power or the use of a battery pack or solar energy panel.

GENERAL SUMMARY DISCUSSION OF INVENTION

Thus, the present invention is directed to a display having a supporting base surface upon which are mounted a number of separate, hollow indicia elements that serve as containers for one isolated chemi-luminescent chemical or both mixed chemicals, which indicia are formed in the shape of the indicia themselves (e.g. letters, numbers, aesthetic designs, logos, etc.), so that the chemi-luminescent to be produced emanates from the very interior of the indica elements themselves for enhanced illumination. Additionally, at least one reservoir, containing at least the other chemi-luminescent chemical or both chemicals in isolation, is also mounted on the support surface or the indicia, with the interiors of the indicia elements and the interior of the reservoir being communicatively connected together but isolated from one another by a divider. The divider is designed to be easily ruptured, fractured, broken or otherwise removed, when desired, to allow the chemical(s) in the reservoir to flow into the interiors of the indicia elements, with the chemicals being mixed together, ultimately causing the chemi-luminescent light to be generated internally within the indicia elements themselves.

The reservoir is preferably longitudinally extended and located above and adjacent to the top portions of the indicia elements, with a series of connecting lines or other openings extending from the bottom of the reservoir to the tops of the indicia elements. This allows inter alia the force of gravity to induce or assist in the flow and mixing of the two chemicals, although some shaking or other movement of the display may be desirable in respect to certain designs. Multiple reservoirs to serve multiple lines of indicia elements is also contemplated and disclosed.

In some embodiments one of the chemicals is stored in the indicia elements themselves prior to mixing; while in others both chemicals are stored in isolation in the reservoir, which can be easily replaced when needed, with the chemicals thereafter in mixed or "being mixed" form flowing into the hollow indicia elements.

When it is desired to illuminate the indicia on the display, the isolation between the reservoir and the lettering is broken by rupturing or otherwise removing the dividing member, allowing the two chemicals to mix, causing the indicia on the sign to then become internally illuminated.

Two initial, alternative embodiments are described to accomplish this, one in which the reservoir is flexed and the other in which the outer surface of the reservoir is pressed, increasing the internal pressure on the contained fluid sufficient to burst or fracture the divider. Other means are also suggested.

In two other embodiments, in which both chemicals are stored in isolation before use in the reservoir, the reservoir has two chambers, one above the other or one next to the other for the two chemicals. In this "self-contained" approach, the reservoir is provided in a snap-on, snap-off configuration, which allows the chemicals to be easily replaced over time, as may be needed to either replace "stale" chemicals or to provide a new chemical charge after the sign has been illuminated and the originals chemicals used. In this approach at least two divider sections need to be ruptured or removed, the one isolating the two chemical storage chambers and the one isolating the reservoir from the indicia elements. Supplemental piercing members are included to assist in this rupturing.

An exemplary, particularly efficacious use of the display principles of the invention is in an emergency sign in which lettering making up an emergency message is displayed by the indicia elements. The lettering or other indicia to be internally illuminated preferably is mounted on a sheet of relatively "rigid" material, which in an exemplary embodiment preferably has a regular, geometric shape, such as, for example, a polygonal or octagonal configuration or outline, and in particular the octagonal shape of the vehicular traffic "stop" sign and is preferably made of material having a bright, attention getting color (e.g. orange) for its supporting and surrounding surfaces.

When an emergency exists or assistance is needed, the divider isolating the two chemicals is broken or removed to internally illuminate the indicia on the sign, which then can be mounted or displayed, for example, in a vehicle or home or shop window.

It is thus an object of the invention to provide a display of indicia in which a chemi-luminescent light is created internally within the indicia itself, with one of the chemicals being stored in isolation from one another until it is needed in an adjacent reservoir.

It is further an object to use such a display in an emergency type sign, such as "CALL 911" for use in association with a vehicle or home or business use.

It is still a further object to provide an approach that allows for easy replacement on the display of a "fully self-contained" reservoir which has both chemicals isolatingly stored within it, with, for example, quick and easy snap-on and snap-off features.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 1 is a front view of a first type of an exemplary, preferred embodiment of the chemi-luminescent, emergency sign of the present invention incorporating the internal chemi-luminescent illumination of the indicia of the present invention, with one chemical being stored in the indicia elements themselves and the other stored in an adjacent, top reservoir, with two exemplary lines of indicia with two separate reservoirs being illustrated; while FIG. 2 is an edge, side, cross-sectional view, taken along section lines 2—2 of FIG. 1, illustrating in close-up detail an exemplary embodiment of the reservoir and an adjacent one of the indicia elements with the connector line between them and the divider in the bottom of the reservoir which, until use, isolates the chemical in the reservoir from the chemical in the indicia container.

FIG. 4 is a front view of a second type of an exemplary, preferred embodiment of the chemi-luminescent, emergency sign of the present invention incorporating the internal chemi-luminescent illumination of the indicia of the present invention, with both chemicals being stored in a snap-on, snap-off, top reservoir having two chemical storage compartments, again with two exemplary lines of indicia with two separate reservoirs being illustrated; while

EXEMPLARY MODE FOR CARRYING OUT THE INVENTION

Figure 3:
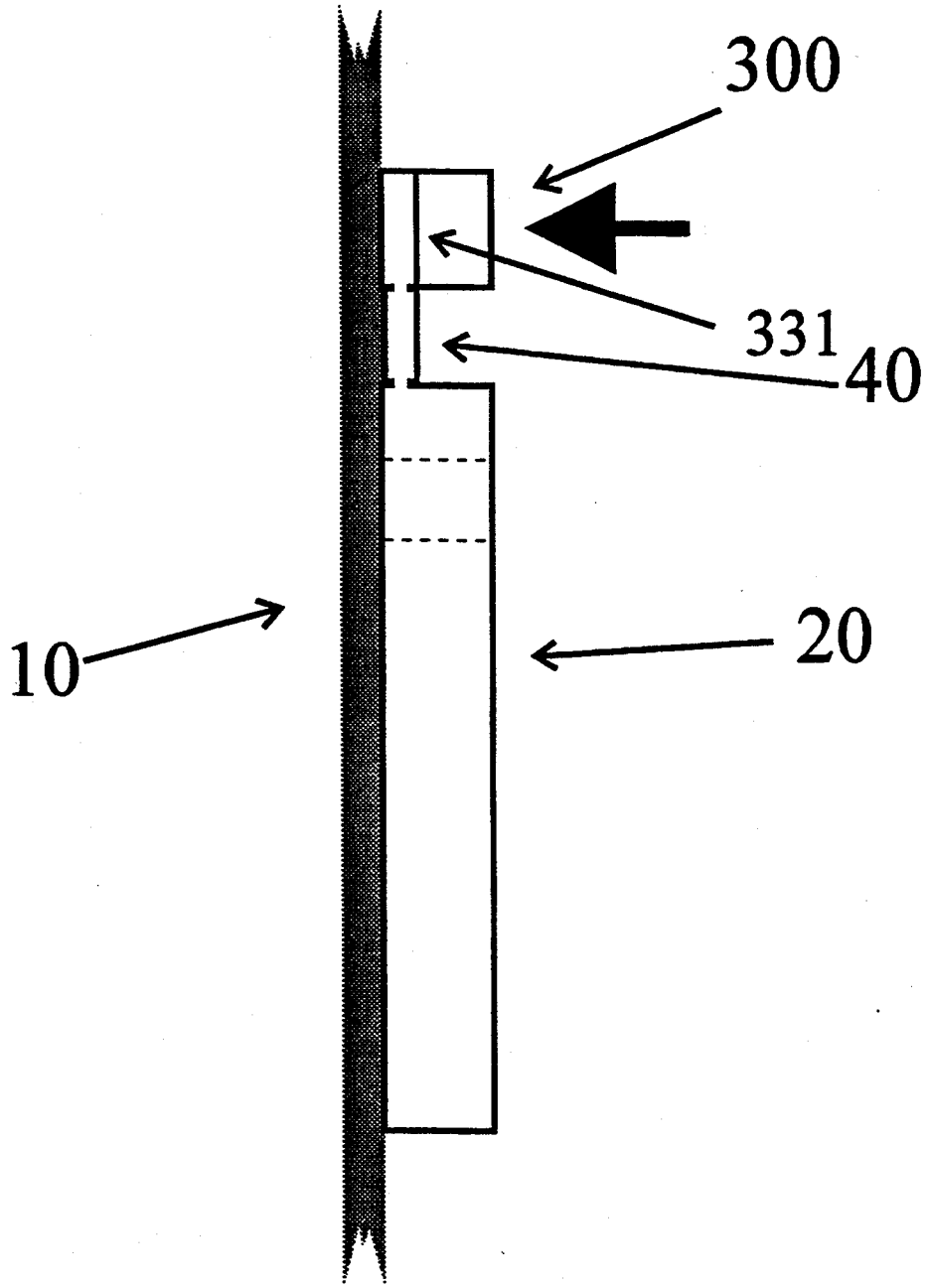
FIG. 3 is an edge, side, cross-sectional view, similar to that of FIG. 2, but illustrating in close-up detail an alternative embodiment for rupturing or otherwise breaking the divider member for isolating the chemicals before use of the sign is needed.

As can be seen in FIG. 1, the first, preferred, exemplary embodiment of the luminescent sign of the present invention includes an octagonally shaped sign 10, of plastic, cardboard, poster board, "Masonite," particle board or other suitable material, colored, for example, in orange, and having some intelligible, aesthetic or informational indicia 20, such as, for example, the phrase "CALL 911" or other suitable message or information or design. The exemplary, illustrated sign with a "CALL 911" message would be particularly useful in emergency situations and would be illuminated by the user by chemi-luminescence action when so desired, in an action described more fully below.

Each line of lettering of the indicia 20 comprises a series of separate, individual, hollow containers, each bent or otherwise shaped to form a letter 20 (or other design) and containing a certain, liquid chemical, which as explained more fully below, is ultimately used to illuminate the letter (or design). Located above each line of the indicia 20 is a hollow, horizontally disposed, laterally extended, plastic tube 30 that contains a related, liquid chemical. The mixed combination of the two chemicals will cause the letters of the indicia 20 to glow or luminesce with strong, internally emanating light. It should be noted that the indica containers 20, prior to the divider 31 being broken, are not completely filled and indeed are, for example, about half filled, in order to leave space or room for the reservoir liquid to come in and mix with the indicia liquid to produce the chemi-luminescence.

As can be seen, the panel divider 31 is made of relatively thin membrane member extending across the bottom portion of the reservoir chamber 30, isolating the chemical in the upper portion of the chamber from the chemical in the individual indicia containers or elements 20, until steps are taken to break or rupture the divider. As can be seen in the figures, the divider member 31 is laterally extended, extending above and completely over the areas at the bottom of said reservoir where it is connected to said indicia 20 by said connector tubes or lines 40, effectively isolating the reservoir chemical from the indicia chemical. The divider member 31 thus results in each reservoir 30 being communicatively connected to the indicia elements 20 but with isolation until full communication between the two is desired.

Each reservoir 30 at least generally follows the base line (or more accurately the top line) of the lettering, with multiple reservoirs being used for multiple lines of texts, one for each line, located preferably adjacent to and extended along or parallel to its respective base (or top) line. Thus, more than one series of indicia elements 20 are used, one, for example, being presented in one line of lettering and the other presented in a lower line of lettering.

Hence, as can be seen in FIG. 1, two reservoirs 30 are provided, an upper one above the letters 20 for the word "CALL" and the other, lower one being located right above the indicia "911" 20. If the indicia on a sign or display is variably splayed, that is, for example, the base portions of the letters are wider apart then their top portions, following, for example, an arc, the reservoir preferably should follow the contour of the upper portions of the lettering.

If so desired, the reservoir could be integrated into, for example, the upper portion of each indicia, preferably with some common means of removing the dividing, isolating member in each one. However, having one, laterally extended, common reservoir for each line of lettering or other indica with a single, thin, dividing membrane or member is currently the most preferred approach.

As noted, the mixing of the two chemicals is achieved by breaking membrane 31 by, for example, bending the distal ends of the plastic tube 30 until the membrane 31 snaps or otherwise ruptures. The membrane 31, being snapped or ruptured, allows the upper chemical located in tube 30 to flow down under, for example, the force of gravity through a small hollow tube or connecting line 40 and into the separate letters of the indicia 20, as can best be understood from the details illustrated in the close-up view of FIG. 2. The two chemicals having mixed, illuminate from inside the indicia 20, through a well-known, chemi-luminescent reaction, thus causing the indicia 20 to stand out against the background of the sign 10 itself and, for example, be highly visible or noticeable to passing motorists or other passers-by.

Thus, the first and second chemicals, from the reservoir 30 and in the indicia 20, respectively, when mixed together produce significant luminescence (e.g. like a "light stick") for a significant period of time, for, for example, at least a number of hours (e.g. 8 hours), having significant persistence. It should be noted that, because the container elements 20 themselves form the indicia, that is, they are one and the same, the luminescence emanates internally out of the interior of the indicia themselves rather than merely being back-lighted.

Thus, the great lighting effect of the invention is in contrast to those devices or designs which merely provide back-lighting for some indicia printed on an external surface, as in some of the prior art approaches, with such back-lighting extending well beyond the lateral and vertical bounds of the indicia.

Hence, for example, when an emergency situation occurs, the isolation membrane 31 is broken or ruptured by the user flexing the terminal or distal ends of the reservoir 30 up and down away from and toward, or up and down along, the surface of the sign 10, rupturing the divider membrane, causing or allowing the active chemical ingredients to be mixed, thereby causing the lettering to become internally illuminated for passers-by to see. The user can then display the sign 10 in, for example, a vehicle window in a quest for assistance after, for example, a break-down, or, for further example, by a shop owner or associate displaying the sign through a show window to alert the police of a robbery or other disturbance or emergency in progress. In such a window display, the internally illuminated indicia 20 would be highly visible and intelligible, whether during the day or the night.

An alternative embodiment for the reservoir type of FIG. 1 is illustrated in FIG. 3, in which the reservoir 330 and the divider member or membrane 331 are designed so that external pressure [e.g. about five (5 psi) pounds per inch] applied down (note direction arrow) on the outer surface of the reservoir by, for example, the user's thumb with significant force causes the divider to rupture or break.

Besides snapping or tearing by flexing (FIG. 2) or by external, inwardly directed pressure (FIG. 3), to break the thin membrane divider 31, other means of rupturing an isolating member include supplemental mechanical means such as a piercing plunger or other suitable rupturing means or, for further example, a removable, extended tape that can be pulled out of a reservoir chamber 30 to initiate mixing, and in essence be equivalently rupturable, etc. However, using a thin membrane or plastic panel 31, as generally illustrated in the drawings, that can be easily snapped or broken or otherwise ruptured is currently the most preferred approach to ending the isolation of the chemicals to allow their mixing to produce the desired chemi-luminescence "on demand" for the embodiments of FIGS. 1–3.

Figure 4:
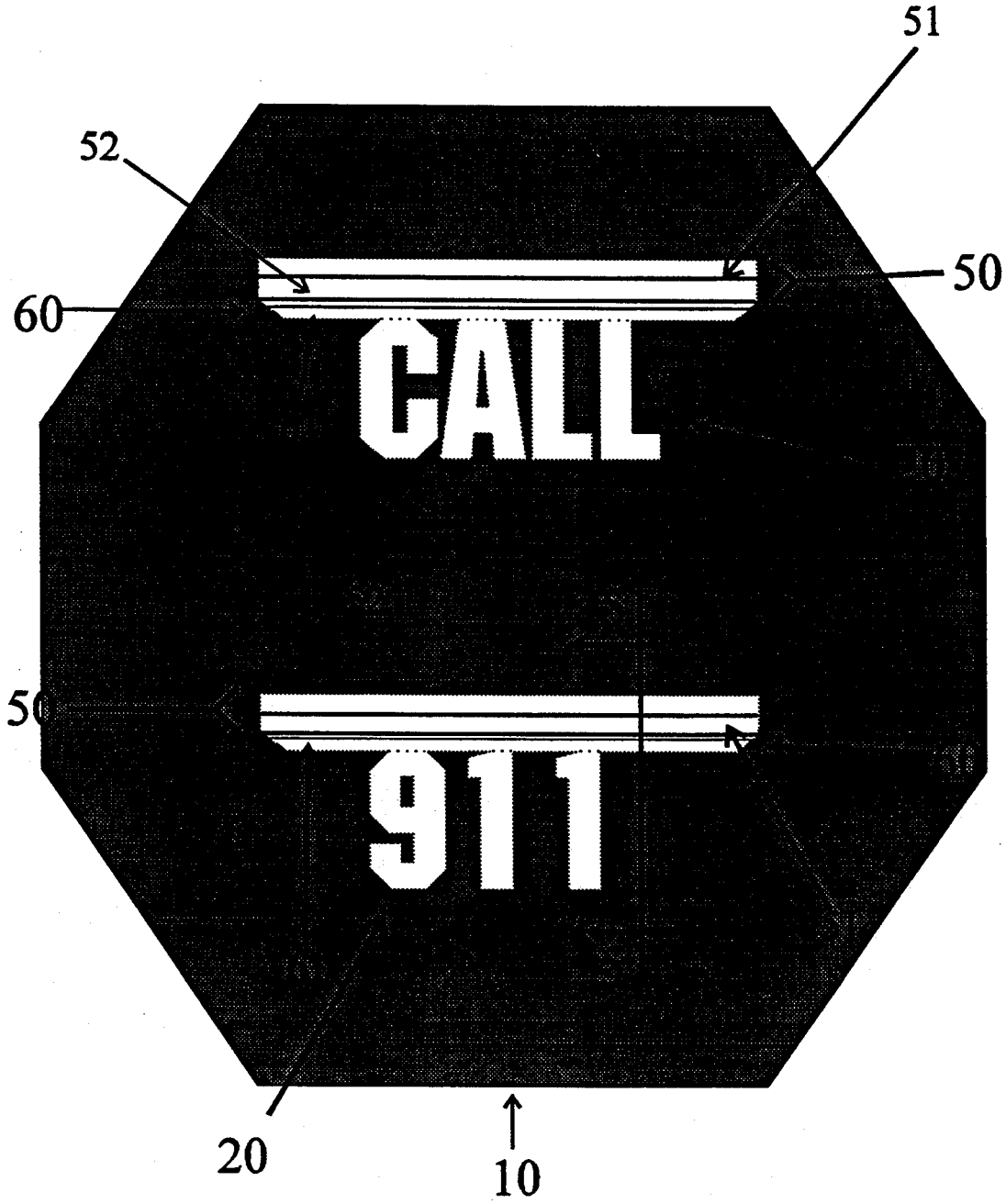
Figure 5:
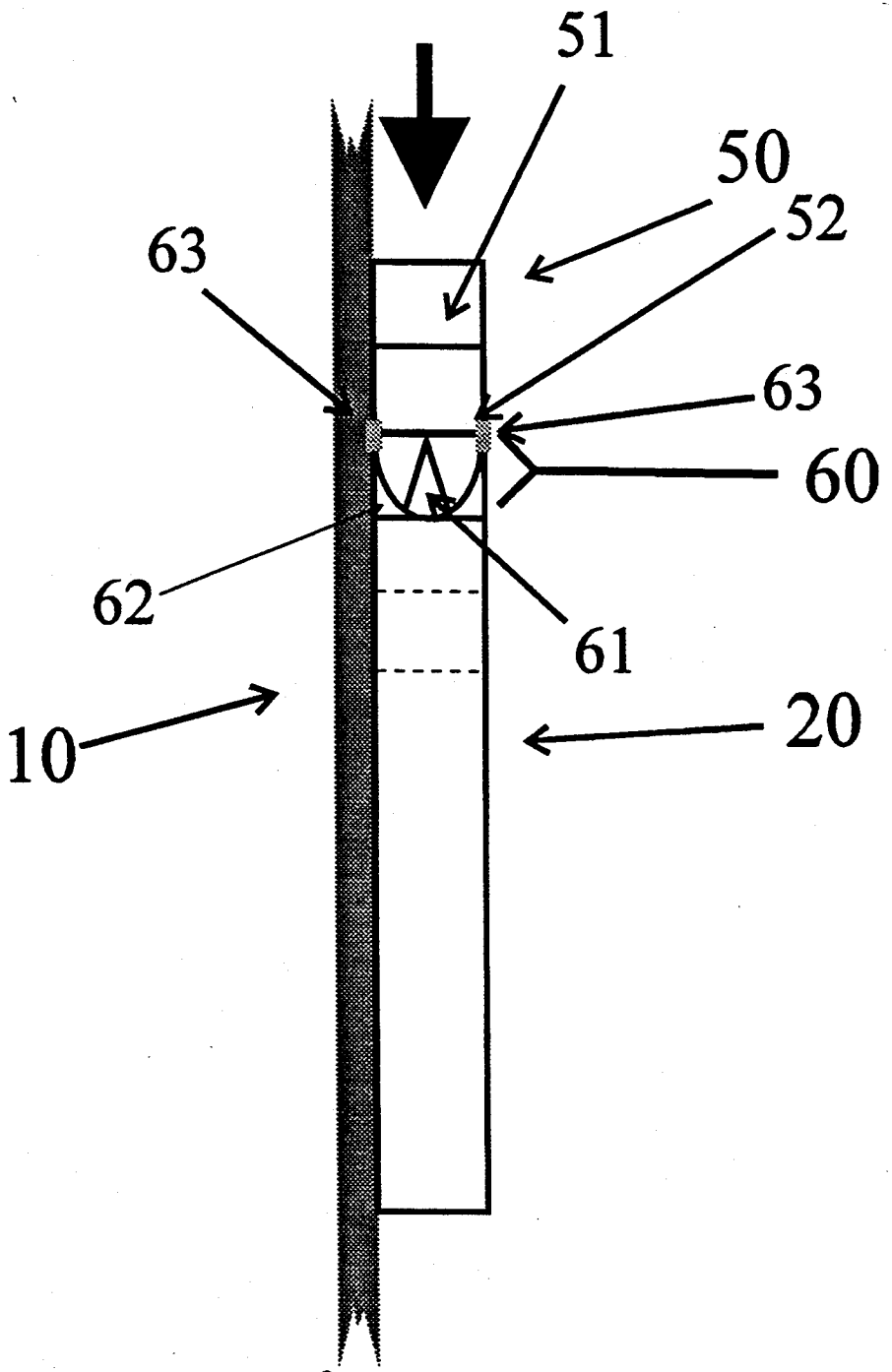
FIG. 5 is an edge, side, cross-sectional view, taken along section lines 5—5 of FIG. 4, illustrating in close-up detail an exemplary embodiment of the dual compartment reservoir, with the dual compartments for the chemicals being located one on top of the other with a piercing element positioned to pierce the divider between the reservoir and the indicia elements.
Figure 6:
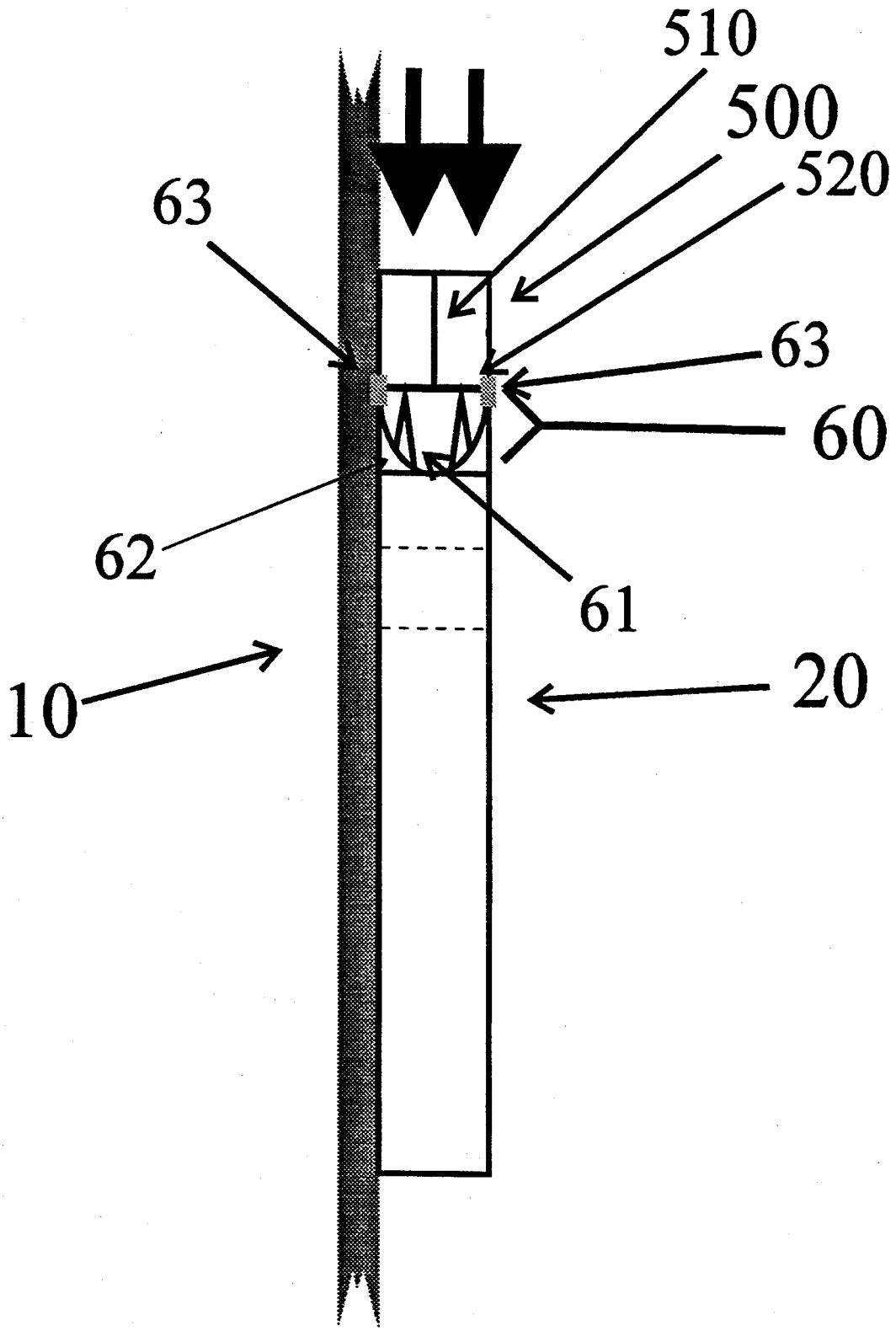
FIG. 6 is an edge, side, cross-sectional view, similar to that of FIG. 5, but illustrating in close-up detail an alternative embodiment for the dual compartmented reservoir, with the dual compartments for the chemicals being located one along side of the other, with two piercing elements positioned to pierce the divider sections between the reservoir and the indicia elements and the two compartments for the chemicals.

A further type of exemplary embodiment of the invention is illustrated in FIGS. 4–6, in which the reservoir 50/500 has two compartments and contains both chemi-luminescent chemicals within it, with the indicia elements themselves being empty until used for illumination. This approach of the invention allows for easy replacement of "stale" or spent chemicals, when so desired.

The indicia elements 20 preferably include at their tops an integrally molded, trough structure 60 which preferably extends completely across the indicia's combined width. The trough 60 thus bridges all of the individual indica elements in a particular line, so that the liquid chemicals from the reservoir 50 (500) can flow down into all of the hollow indicia elements of that line of lettering.

The dual compartments for the chemicals in the reservoir 50 in the embodiment of FIG. 5 are located one above the other with a dividing membrane 51 isolating the stacked, adjacent compartments; while the dual compartments for the chemicals in the reservoir 500 in the alternative embodiment of FIG. 6 are located one along side the other, in side-by-side fashion, with a dividing membrane 510 forming a common wall isolating the shoulder-to-shoulder, adjacent compartments from one another. In the latter embodiment, one section of the divider 52 forms a bottom wall for one compartment and the adjacent section forms a bottom wall for the other compartment.

In the embodiment of FIG. 5 a series of in-line, laterally spaced, integrally molded, piercing members 61 are supported on the curved bottom 62 of the trough 60 to assist in rupturing or breaking of the dividing membrane or panel 52 isolating the reservoir 50 and the indicia elements 20, when it is desired to mix the chemicals for internal illumination of the indicia. In the embodiment of FIG. 6 a dual, parallel, side-by-side series of in-line, laterally spaced, integrally molded, piercing members 61 are supported on the curved bottom 62 of the trough 60, with one series under one of the chemical compartments and the other series under the other chemical compartment. The piercing members 61 assist in rupturing or breaking of the dividing membrane or panel sections 520 isolating the reservoir 500 and the indicia elements 20 and effectively the chemicals from one another, when it is desired to mix the chemicals for internal illumination of the indicia and the membrane divider 52 is pushed or otherwise moved toward the piercing members 61 and against their upward, pointed tips.

The reservoir 50 (500) is firmly and securely but removably attached to the upper, trough part 60 of the indica elements 20 by means of snap-connectors 63. This allows a reservoir to be easily removed or snapped-off from the indicia elements 20, to be replaced by another reservoir which is then snapped on in its place. This allows for the easy upgrading or replacement of "stale" chemicals or for the substitution of a new reservoir for a spent or used reservoir.

When it is desired to mix the chemicals in the reservoir 50 of FIG. 5, pressure is applied to the external surface(s) of the compartments, for example, at its top (note direction arrow) with sufficient force to rupture the membrane divider 51 between the chemical compartments and to also rupture the membrane divider or panel 52 between the reservoir and the indica trough 60. The presence of the piercing members 61 further insures a good rupturing or breaking of the reservoir/indicia divider 52. This allows the chemi-luminescent chemicals to mix and to flow down into the hollow indicia elements, internally illuminating them.

When it is desired to mix the chemicals in the reservoir 500 of FIG. 6, pressure is applied to the external surface(s) of the compartments, for example, at its top (note direction arrows) with sufficient force to rupture at least the membrane divider or panel 52 between the reservoir and the indica trough 60. Because the chemical compartments both share the membrane sections 52 as one of its respective confining walls, there is no necessity that the common wall between the compartments be ruptured. The presence of the two sets of laterally spaced piercing members 61, one below one compartment and the other below the other compartment, further insures a good rupturing or breaking of the reservoir/indicia divider sections 52 along its length and depth. This allows the chemi-luminescent chemicals from the reservoir to mix together and to flow down into the hollow indicia elements through bottom openings (note dashed lines at the top of the indicia 20 in FIG. 4) in the trough, internally illuminating the indicia.

As noted above, the upper chemical(s) from the reservoir 30/330 (50/500) flows down under the force of gravity. To enhance the flow and intermixing of the chemi-luminescent chemical, the sign 10 can, for example, be shaken up-and-down or twirled about in a circle using centripetal force to aid the flow and mixing of the chemicals. Of course, in the embodiments of FIGS. 1–3, the indicia elements 20 are only partially filled with their respective chemicals to allow room for the other chemical in the reservoir 30 to come in and be mixed for producing the internal chemi-luminescence.

A number of chemicals are available, which when mixed together, cause luminescence. For further background information note, for example, U.S. Pat. Nos. 3,539,794 & 3,597,362. Such technology is used in the well know "light sticks" that are readily available in the trade.

Of course, the particular configuration of the sign 10 and the indicia 20 can take on many different shapes, forms, and coloration, etc. Exemplary dimensions of the "Call 911" sign illustrated could be, for example, about fifteen (15") inches in height and width and a thickness of about five (5) mils, with the divider having a thickness of about a half a mil or less (e.g. $\frac{3}{8}$ mil). However, of course, it should be understood that this likewise is subject to great variation.

Also, although the exemplary embodiments illustrated and described would be particularly useful for carrying in, for example, a vehicle for emergency use in connection with a break-down, or for a home or business to have available for display in, for example, a window when a robbery or other emergency arose, many other purposes and uses of the invention are, of course, also possible. Likewise, although informational messages are considered a particularly efficacious use of the invention, purely aesthetic or artistic uses are also possible.

The materials that are used are likewise subject to great variation, all as known to those of ordinary skill in the art. For example, the material for the indicia elements 20 could be, for further example, glass, as well as plastic, and be translucent, rather than transparent. It should be understood that the term "translucent" as used herein is considered to broadly encompass the term "transparent." Exemplary plastics would be polypropelene, ethylene, etc.

The exemplary embodiments of the sign 10 can further include a series of suction cups on their front or rear sides which would allow the sign to be quickly or temporarily fastened to, for example, a car window or a house or store window. Holes can be provided about the periphery of the sign 10 for attaching the mounting stubs of the suction cups. Additionally, the sign 10 can be designed to have one or more fold axes horizontally across it width for ease in storage, packing and shipping, or the material and design of the sign 10 could be chosen to allow the sign to be generally rolled up for storage, although some accommodation for the reservoir(s) might be necessary.

As previously noted, in addition to a "911" emergency sign, the text or lettering and intent of the sign can be in many other forms with many other messages or designs, from political campaign signs, parade signs, information and promotional signs, etc., to artistic renderings, etc.

Thus, it is noted that the embodiments described herein in detail for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

I claim:

1. A display, such as a sign or the like, comprising:

a base surface;

a hollow reservoir supported in association with said base surface;

at least a first, chemi-luminescent chemical in liquid form contained in said reservoir;

a series of individual, spaced, hollow, translucent, indicia elements supported on said base surface, each of said elements having a hollow interior and following and presenting the form of intelligent or artistic indicia, said reservoir being communicatively connected to said series of indicia elements but being isolated from said interior of said elements by an easily rupturable divider; and a second, chemi-luminescent chemical in liquid form contained in either said spaced, hollow indicia or said reservoir and isolated from said first chemical, said first and second chemicals being mixed together upon the rupturing of said divider, producing significant luminescence for a significant period of time, illuminating from internally said indicia elements.

2. The display of claim 1, wherein:

said indicia elements at least in part form at least one line of lettering having upper portions; and wherein said reservoir forms an elongated container for said first chemical extending along and above and connected to said upper portions of said lettering.

3. The display of claim 2, wherein there is further included:

a series of individual, separate connector lines extending from said reservoir to said lettering, one connector line for each letter.

4. The display of claim 2, wherein:

said indicia elements forms a second line of lettering having upper portions; and wherein there is further included:

a second, separate, elongated container containing said first chemical extending along and above and connected to said upper portions of said second line of lettering.

5. The display of claim 4, wherein:

said first line of lettering forms the word "call" and said second line of lettering forms the indicia "911".

6. The display of claim 1, wherein:

said reservoir forms an elongated, laterally disposed container having a main body containing said first chemical and extends along and above and is connected to the upper portions of said indicia elements, said reservoir being connected to said upper portions through the bottom of said reservoir; and said divider is a thin, laterally extended member located at the bottom of said elongated reservoir extending above and completely over at least the areas at the bottom of said reservoir at which it is connected to said indicia, isolating the connections from said main body of said reservoir containing said first chemical.

7. The display of claim 1, wherein:

said base surface is flat and thin.

8. The display of claim 7, wherein said display is a sign, and wherein:

said reservoir and said indicia are formed of transparent, plastic, tubular like members.

9. The display of claim 7, wherein:

said flat base surface has a regular, geometrical shape for its outer periphery.

10. The display of claim 1, wherein:

said reservoir includes two, adjacent compartments isolated from one another, said first and second chemicals being separately located in said two compartments.

11. The display of claim 10, wherein:

said reservoir and the tops of said indicia elements are separably connected together with snap connectors securely holding the reservoir to said indicia elements but allowing them to be snapped apart for replacement of reservoir with another.

12. The display of claim 10, wherein:

first and second adjacent compartments are side-by-side, sharing a common wall between them; and wherein:

said divider has first and second in-line sections, said first in-line section forming a bottom wall for said first compartment and the second in-line section forming a bottom wall for the second compartment;

there being further included:

a series of piercing members located above said indicia elements and below said reservoir, some located below said first in-line section and others located below said second in-line section, serving to pierce said in-line sections, allowing the chemicals to mix and flow into said indicia elements, when said sections are moved toward said piercing members.

13. A display sign, comprising:

a fiat, thin, colored base surface having a regular, geometrical shape for its outer periphery;

first and second, hollow reservoirs supported in association with said base surface;

at least a first, chemi-luminescent chemical in liquid form contained in both of said first and second reservoirs;

a series of individual, spaced, hollow, translucent, indicia elements supported on said base surface, each of said elements having a hollow interior and following and presenting the form of intelligent or artistic indicia; said indicia elements at least in part forming multiple lines of lettering having upper portions, at least a first line of lettering and a second line of lettering;

said first reservoir forming an elongated container for said first chemical and extending along and above and connected to said upper portions of said first line of lettering, said first reservoir being communicatively connected to said first line of lettering by a series of individual, separate connector openings extending from the bottom of said first reservoir to said upper portions of said first line of lettering, one connector opening for each letter, but being isolated from said interiors of said first line of lettering by a rupturable divider; and said second reservoir forming an elongated container for said first chemical and extending along and above and connected to said upper portions of said second line of lettering, said second reservoir being communicatively connected to said second line of lettering by a series of individual, separate connector openings extending from the bottom of said second reservoir to said upper portions of said second line of lettering, one connector opening for each letter, but being isolated from said interiors of said second line of lettering by a rupturable divider; and a second, chemi-luminescent chemical in liquid form contained in either each one of said spaced, hollow indicia elements or the associated one of said reservoirs, said first and second chemicals being mixed together upon the rupturing of said dividers, with said first chemical flowing down from said reservoirs to their respective line of lettering at least in part under the force of gravity, producing significant luminescence for a significant period of time, illuminating from internally both lines of said lettering.

14. The sign display of claim 13, wherein:

said reservoirs and said indicia elements are formed of transparent, plastic, tubular like members.

15. The display of claim 13, wherein:

said first line of lettering forms the word "call" and said second line of lettering forms the indicia "911" and said geometrical shape is octagonal.

16. A method of presenting information or aesthetic design through a display, comprising the following steps:

(a) providing a display including a base surface;

a hollow reservoir supported in association with said base surface;

at least a first, chemi-luminescent chemical in liquid form contained in said reservoir;

a series of individual, spaced, hollow, translucent, indicia elements supported on said base surface, each of said elements having a hollow interior and following and presenting the form of intelligent or artistic indicia, said reservoir being communicatively connected to said series of indicia elements but being isolated from said interior of said elements by a rupturable divider; and a second, chemi-luminescent chemical in liquid form contained in either said spaced, hollow indicia or said reservoir but isolated from said first chemical; and (b) rupturing said divider and allowing said first chemical to flow from said reservoir into said indicia elements, mixing said first and said second chemicals together, producing significant luminescence for a significant period of time, illuminating from internally said indicia elements.

17. The method of claim 16, wherein there is included the further step of:

shaking the sign after rupturing said divider to enhance the mixing together of said first and second chemicals.

18. The method of claim 16, wherein said indicia elements of the sign form an emergency message, and wherein there is included the further step of:

displaying the sign through a window, after rupturing said divider and mixing together said first and second chemicals, so that the emergency sign can be viewed through the window while said indicia elements are internally illuminated by the action of said chemical mixture.

19. The method of claim 16, wherein said "rupturing" step of step "b" includes the step of:

bending the distal ends of the reservoir to cause the divider to break.

20. The method of claim 16, wherein said "rupturing" step of step "b" includes the step of:

pressing down on the outer surface of the reservoir, increasing the pressure on the chemical in said reservoir, with sufficient force to cause the divider to rupture.

* * * * *